US010829702B1

(12) United States Patent
Gattupalli et al.

(10) Patent No.: US 10,829,702 B1
(45) Date of Patent: Nov. 10, 2020

(54) DEHYDROGENATION PROCESS FOR GASOLINE PRODUCTION

(71) Applicant: UOP LLC, Des Plaines, IL (US)

(72) Inventors: Rajeswar Gattupalli, Buffalo Grove, IL (US); Mohamed Shakur, Hoffman Estates, IL (US); Mark P. Lapinski, Aurora, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 16/454,513

(22) Filed: Jun. 27, 2019

(51) Int. Cl.

| | |
|---|---|
| ***C10G 63/00*** | (2006.01) |
| ***C10G 63/02*** | (2006.01) |
| ***C10G 7/02*** | (2006.01) |
| ***C10G 35/24*** | (2006.01) |
| ***C10G 35/04*** | (2006.01) |
| ***C10G 45/32*** | (2006.01) |

(52) U.S. Cl.
CPC ..... *C10G 63/02* (2013.01); *C10G 7/02* (2013.01); *C10G 35/04* (2013.01); *C10G 35/24* (2013.01); *C10G 45/32* (2013.01); *C10G 2300/1081* (2013.01); *C10G 2300/1096* (2013.01); *C10G 2300/305* (2013.01); *C10G 2300/4018* (2013.01); *C10G 2400/02* (2013.01); *C10G 2400/20* (2013.01); *C10G 2400/22* (2013.01)

(58) Field of Classification Search
CPC ..... C10G 63/02; C10G 7/02; C10G 35/04; C10G 35/24; C10G 45/32; C10G 2300/1081; C10G 2300/1096; C10G 2300/305; C10G 2300/4018; C10G 2400/02; C10G 2400/20; C10G 2400/22
See application file for complete search history.

(56) References Cited

U.S. PATENT DOCUMENTS 2,944,959 A * 7/1960 Kline ..... C10G 59/06 208/79
5,430,221 A * 7/1995 Gajda ..... C10G 61/02 585/259

(Continued)

FOREIGN PATENT DOCUMENTS

GB 1186095 4/1970

*Primary Examiner* — Prem C Singh
*Assistant Examiner* — Brandi M Doyle

(57) ABSTRACT

A process for production of gasoline comprising separating a naphtha feed in a naphtha splitter into a stream comprising i-$C_5$, a stream comprising $C_6$ and lighter boiling hydrocarbons, a $C_7$ stream comprising $C_7$ hydrocarbons, and a heavy stream comprising $C_8$ and heavier hydrocarbons; isomerizing at least a portion of the stream comprising $C_6$ and lighter boiling hydrocarbons in a $C_5$-$C_6$ isomerization zone at isomerization conditions to form a $C_5$-$C_6$ isomerization effluent; dehydrogenating at least a portion of the stream comprising $C_7$ hydrocarbons to form a $C_7$ dehydrogenation effluent comprising $C_7$ olefins; reforming the heavy stream in a reforming zone under reforming conditions forming a reformate stream; and blending one or more of the stream comprising i-$C_5$, the $C_5$-$C_6$ isomerization effluent, the $C_7$ dehydrogenation effluent and the reformate stream to form a gasoline blend.

20 Claims, 2 Drawing Sheets

(56) References Cited

U.S. PATENT DOCUMENTS

| | | | | |
|---|---|---|---|---|
| 7,612,246 | B2 | 11/2009 | Broutin et al. | |
| 8,470,165 | B2 | 6/2013 | Cosyns et al. | |
| 9,024,097 | B2 | 5/2015 | Serban et al. | |
| 9,029,618 | B2 | 5/2015 | Serban et al. | |
| 9,079,817 | B2 | 7/2015 | Moser et al. | |
| 2006/0106266 | A1* | 5/2006 | Broutin | C10L 1/06 585/418 |
| 2013/0158320 | A1 | 6/2013 | Moser et al. | |
| 2014/0378700 | A1 | 12/2014 | Majumder et al. | |

* cited by examiner

DEHYDROGENATION PROCESS FOR GASOLINE PRODUCTION

FIELD OF THE INVENTION

The invention relates to a process for producing high octane gasoline. The process incorporates a dehydrogenation unit to convert $C_5$ to $C_8$ saturated hydrocarbons to olefins.

BACKGROUND OF THE INVENTION

Gasoline specifications are becoming stricter and more difficult for refiners to meet. For hydrocracker-based refineries, which rely on the reforming and isomerization units to produce gasoline, it is difficult to meet the aromatics specifications in the Euro V gasoline standard while maximizing 95 RON (research octane number). Euro V standards limit gasoline to concentrations of no more than 35 lv % aromatics and no more than 1.0 lv % benzene with additional limitations on distillation and Reid vapor pressure (RVP). It is common that a refiner cannot process as much reformer feed due to the aromatics limitation thus resulting in the need to sell heavy naphtha that has lower value, thus reducing the refiner's profitability. A refiner can add oxygenates such as methyl tert-butyl ether (MTBE) or tertiary amyl methyl ether (TAME) to the gasolines to increase octane, but these can be expensive and there may be additional environmental regulations against these compounds. The Euro V specifications also limit the amount of olefins that can be added to the gasolines to 18 lv %. For hydrocracker-based, condensate-based or other refineries that do not add a significant amount of olefins to the gasolines, producing an olefin stream can be advantageous due to an increase in octane over paraffins. Since these refineries have low olefins in their gasolines, a significant amount of olefins can be blended into the gasolines up to the specification.

In a typical naphtha complex configuration, a naphtha splitter distillation column fractionates a hydrotreated full range naphtha stream into light naphtha and heavy naphtha. The light naphtha stream containing $C_5$ and $C_6$ species goes to the isomerization unit to make an isomerate and the heavy naphtha is processed in the reforming unit to make reformate. In the present invention, a $C_7$ stream is fractionated from the naphtha splitter and processed in a dehydrogenation reactor to partially convert paraffins, isoparaffins and cyclopentane compounds to higher octane mono-olefins. For example, the pure component octane of n-heptane is 0.0 RON whereas for the mono-olefin 1-heptene, it is 54.5 RON. Similarly, the pure component octanes for 2-methylhexane and 2,3-dimethylpentane are 42.0 and 91.0, respectively, whereas the pure component octanes of the corresponding mono-olefins range 75.5-97.9 RON and 96.0-99.3 RON, respectively. It is also desired in the present invention to control the fractionation to limit the amount of cyclohexane and methylcyclohexane in the $C_7$ stream since these will dehydrogenate to benzene and toluene which are not desired due to the gasoline specifications.

A once-through conversion in the dehydrogenation reactor can range from 10-25%; higher conversions are possible by reheating the reactor effluent and processing in a second dehydrogenation reactor. Additional reheat and dehydrogenation stages can be added to further increase the conversion to olefins and these depend on the economics for the particular application. There are two advantages for dehydrogenating the $C_7$ stream. The first is that the $C_7$ compounds are not converted to aromatics in the reformer and secondly the $C_7$ compounds are upgraded to higher octane via the production of olefins. Both allow making a larger amount of gasoline that meets the Euro V specifications and reducing the amount of lower value heavy naphtha that needs to be sold. There is additional hydrogen generated by the dehydrogenation unit that can be recirculated to the reformer or other process units. As part of the current invention, $C_5$, $C_6$ or $C_8$ paraffins, isoparaffins and cyclopentane compounds can be included in the $C_7$ feed stream to the dehydrogenation unit. These additional compounds may be fractionated from the naphtha splitter column or may be purchased. In some embodiments, these fractionated or purchased streams can be processed in separate dehydrogenation units to produce $C_5$, $C_6$ and $C_8$ olefins which can be subsequently added to the gasoline pool up to the olefin specification.

In addition, a small amount of diolefins can be produced in the dehydrogenation reactor along with the desired mono-olefins. Diolefins in gasoline are known to be reactive in promoting gum formation, especially in the presence of mono-olefins. Therefore, in some embodiments of the present invention, the dehydrogenated stream is further treated in a selective hydrogenation unit to convert the diolefins to mono-olefins.

The invention provides an increase in efficiency by better utilizing $C_5$ to $C_8$ unsaturated hydrocarbons. A more efficient means of processing naphtha is provided. There is also increased flexibility to meet the specifications of the gasoline pool.

DETAILED DESCRIPTION OF THE INVENTION

Figure 1:
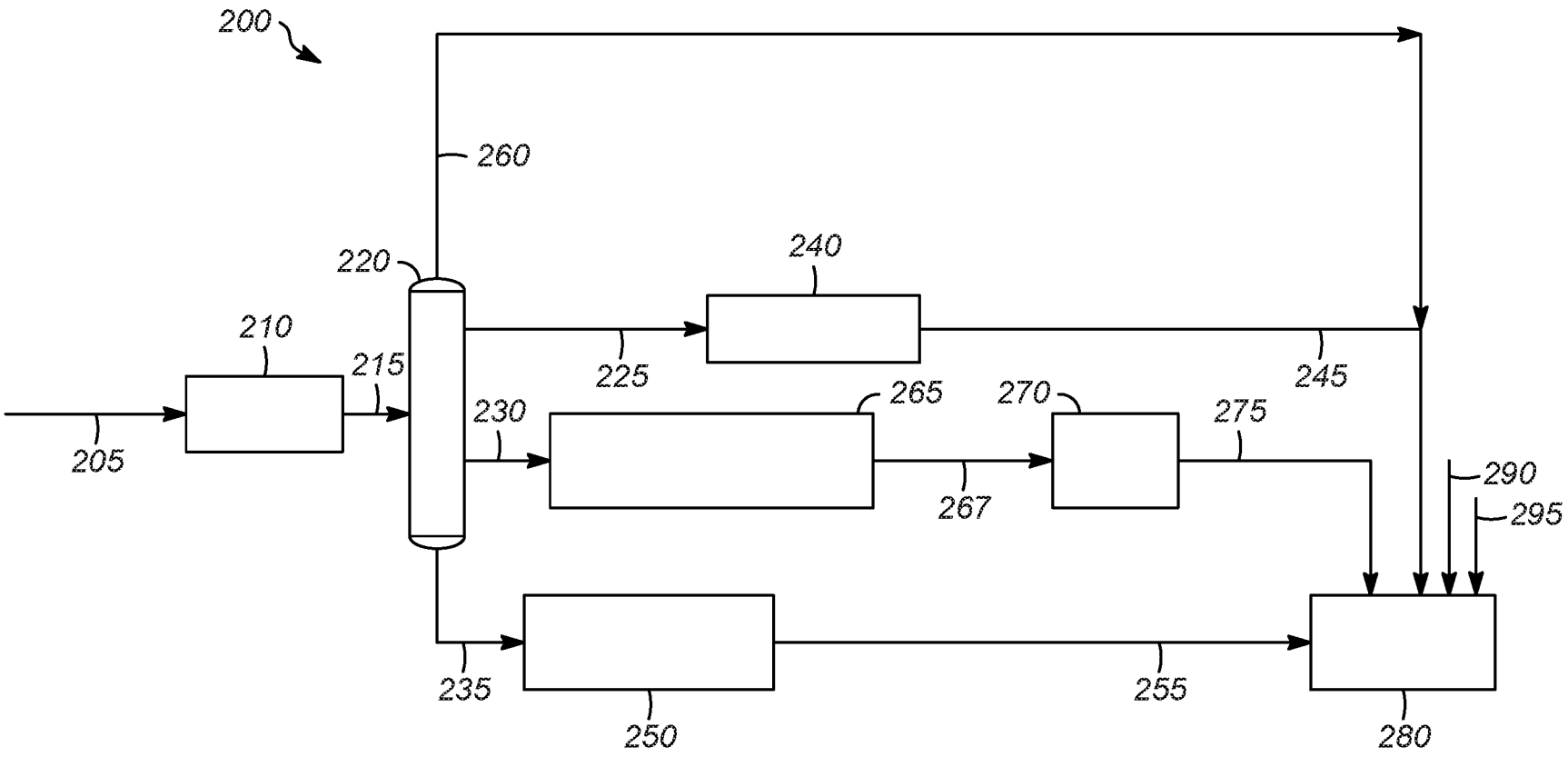
FIG. 1 illustrates one embodiment of a system containing a $C_7$ dehydrogenation zone and a selective diolefin hydrogenation zone.

The $C_7$ feedstock to the dehydrogenation unit is obtained via the fractionation of a hydrotreated full range naphtha. The fractionated cut is rich in $C_7$ paraffins, isoparaffins and cyclopentane compounds such as 1,1-dimethylcyclopentane. As used herein, the term "rich" does not have a minimum required amount other than greater than zero. The feed can also include cyclohexane and methylcyclohexane but these should be minimized in the fractionation in order to avoid dehydrogenating these compounds to benzene and toluene, respectively. These compounds are not desired due to the gasoline aromatic limitations. In addition, large concentrations of cyclohexanes in the feed can lead to rapid dehydrogenation and the quenching of other dehydrogenation reactions due to a large endothermic temperature drop. Feed concentrations less than about 1.5 wt % CH and less than about 2.5 wt % MCH are most preferred. The $C_7$-rich feedstock can also include $C_5$, $C_6$ and $C_8$ paraffins, isoparaffins and cyclopentane compounds such as cyclopentane, methylcyclopentane and 1-methyl-1-ethyl-trimethylcyclopentane. These can be fractionated from the hydrotreated full range naphtha or purchased. In some embodiments, a $C_5$-rich feed stream comprising normal-pentane, isopentane and cyclopentane can be fed to the dehydrogenation unit. In some embodiments, a $C_6$-rich feed stream comprising normal-hexane, isohexanes, and methylcyclopentane can be fed to the dehydrogenation unit. In some embodiments, a $C_8$-rich feed stream containing normal-octane, iso-octanes and $C_8$ cyclopentanes can be fed to the dehydrogenation unit.

In the present invention, a dehydrogenation process is used to dehydrogenate saturated hydrocarbons to the corresponding mono-olefin hydrocarbons in the presence of hydrogen over a selective dehydrogenation catalyst. Normal paraffins are dehydrogenated to the corresponding normal mono-olefins. For example, normal-heptane is dehydrogenated to the mono-olefins 1-heptene, trans-2-heptene, trans-3-heptene, cis-2-heptene, and cis-3-heptene. Isoparaffins are dehydrogenated to the corresponding mono-iso-olefins. For example, 2,4-dimethylpentane is dehydrogenated to 2,4-dimethyl-1-pentene and 2,4-dimethyl-2-pentene. Cyclopentane compounds are dehydrogenated to cyclopentene compounds. Cyclohexane compounds are dehydrogenated to aromatic compounds. As previous discussed, cyclohexane compounds are minimized in the dehydrogenation feed to prevent undesired aromatic formation and very large endotherms that can quench other dehydrogenation reactions.

The dehydrogenation process can utilize any suitable selective dehydrogenation catalyst. Generally, one preferred suitable catalyst comprises a Group VIII noble metal component (e.g., platinum, iridium, rhodium, and palladium), an alkali metal component, and a porous inorganic carrier material. The catalyst may also contain promoter metals which advantageously improve the performance of the catalyst. The porous carrier material should be relatively refractory to the conditions utilized in the reaction zone and may be chosen from those carrier materials which have traditionally been utilized in hydrocarbon conversion catalysts. A preferred porous carrier material is a refractory inorganic oxide, with the most preferred an alumina carrier material. The particles are usually spheroidal and have a diameter of from about 1/16 to about 1/8 inch (about 1.6 to about 3.2 mm), although they may be as large as about 1/4 inch (about 6.4 mm). Newer dehydrogenation catalysts can also be used in this process. For example, one such catalyst comprises a layered catalyst composition comprising an inner core, and outer layer bonded to the inner core so that the attrition loss is less than 10 wt % based on the weight of the outer layer. The outer layer is a refractory inorganic oxide. Uniformly dispersed on the outer layer is at least one platinum group metal, and a promoter metal. The inner core and the outer layer are made of different materials. A modifier metal is also dispersed on the outer layer. The inner core is made from alpha alumina, theta alumina, silicon carbide, metals, cordierite, zirconia, titania, and mixtures thereof. The outer refractory inorganic oxide is made from gamma alumina, delta alumina, eta alumina, theta alumina, silica/alumina, zeolites, non-zeolitic molecular sieves, titania, zirconia, and mixtures thereof. The platinum group metals include platinum, palladium, rhodium, iridium, ruthenium, osmium, and mixtures thereof. The platinum group metal is present in an amount from about 0.01 to about 5 wt % of the catalyst composition. The promoter metal includes tin, germanium, rhenium, gallium, bismuth, lead, indium, cerium, zinc, and mixtures thereof. The modifier metal includes alkali metals, such as potassium and lithium, alkaline earth metals, and mixtures thereof. Further discussion of two layered dehydrogenation catalysts can be found in U.S. Pat. No. 6,617,381, which is incorporated herein by reference, for example.

The dehydrogenation of saturated hydrocarbons is endothermic, and for normal paraffins, the heat of reaction is about 125 kJ/g mol (30 kcal/gmol; 54,000 Btu/lbmol). It is desired to operate the dehydrogenation process near equilibrium conversions. The equilibrium conversion for the dehydrogenation reaction is determined by the feed components, temperature, pressure, and hydrogen partial pressure. The equilibrium conversion increases with increasing temperature and with decreasing pressure. In order to achieve the desired conversions, the space velocity and other process conditions are set to operate just at or slightly below the equilibrium conversion levels. At lower space velocities or too high temperatures, the equilibrium conversion will be achieved but with an increase in undesired reactions and products including, elevated cracking to light ends, the formation of diolefins, and the formation of aromatics via a sequential dehydrogenation reaction pathway. The formation of light ends will decrease the gasoline yields; the formation of diolefins can increase the gum forming in the gasolines; and the formation of additional aromatics may not be blendable to the gasolines due to the aromatic limitations. In the case of diolefins in the present invention, it is desirable to minimize the formation and/or to eliminate the diolefins from the dehydrogenation effluent by treating the effluent in a selective hydrogenation reactor. To accomplish this, the effluent liquid from the dehydrogenation unit is contacted with a near-stoichiometric amount of hydrogen and passed over a selective hydrogenation catalyst thus converting the diolefins to mono-olefins. The resulting stream can then be added to the gasoline pools.

The selective hydrogenation catalyst can comprise an alumina support material preferably having a total surface area greater than 150 $m^2/g$, with most of the total pore volume of the catalyst provided by pores with average diameters of greater than 600 angstroms, and containing surface deposits of about 1.0 to 25.0 wt % nickel and about 0.1 to 1.0 wt % sulfur such as disclosed in U.S. Pat. No. 4,695,560. Spheres having a diameter between about 0.4 and 6.4 mm (1/64 and 1/4 inch) can be made by oil dropping a gelled alumina sol. The alumina sol may be formed by digesting aluminum metal with an aqueous solution of approximately 12 wt % hydrogen chloride to produce an aluminum chloride sol. The nickel component may be added to the catalyst during the sphere formation or by immersing calcined alumina spheres in an aqueous solution of a nickel compound followed by drying, calcining, purging and reducing. The nickel containing alumina spheres may then be sulfided. A palladium-containing catalyst may also be used as the selective hydrogenation catalyst.

In FIG. 1 is shown a full range naphtha feed stream 205 comprising $C_4$-$C_{12}$ hydrocarbons that is sent to a naphtha hydrotreater 210. Hydrotreating is a process in which hydrogen gas is contacted with a hydrocarbon stream in the presence of suitable catalysts which are primarily active for the removal of heteroatoms, such as sulfur, nitrogen, and metals from the hydrocarbon feedstock. In hydrotreating, hydrocarbons with double and triple bonds may be saturated. Aromatics may also be saturated. Typical hydrotreating reaction conditions include a temperature of about 290° C. (550° F.) to about 455° C. (850° F.), a pressure of about 3.4 MPa (500 psig) to about 6.2 MPa (900 psig), a liquid hourly space velocity of about 0.5 $h^{-1}$ to about 4 $h^{-1}$, and a hydrogen rate of about 168 to about 1,011 $Nm^3/m^3$ oil (1,000-6,000 scf/bbl). Typical hydrotreating catalysts include at least one Group VIII metal, preferably iron, cobalt and nickel, and at least one Group VI metal, preferably molybdenum and tungsten, on a high surface area support material, preferably alumina. Other typical hydrotreating catalysts include zeolitic catalysts, as well as noble metal catalysts where the noble metal is selected from palladium and platinum.

The hydrotreated stream 215 is sent to a naphtha splitter 220 where it is separated into an iso-$C_5$ rich light stream 260, a $C_5/C_6$ rich stream 225, a $C_7$ stream 230, and a heavy stream 235. The $C_5/C_6$ rich stream 225 comprises $C_6$ and lighter boiling hydrocarbons, the $C_7$ stream 230 comprises $C_7$ hydrocarbons, and the heavy stream 235 comprises $C_8$ and heavier hydrocarbons and toluene.

The $C_5/C_6$ rich stream 225 from the naphtha splitter 220 is sent to a $C_5$-$C_6$ isomerization zone 240. The $C_5$-$C_6$ isomerization zone 240 can be any type of isomerization zone that takes a stream of $C_5$-$C_6$ straight-chain hydrocarbons or a mixture of straight-chain, branched-chain, cyclic hydrocarbons, and benzene and converts straight-chain hydrocarbons in the feed mixture to branched-chain hydrocarbons and branched hydrocarbons to more highly branched hydrocarbons, thereby producing an effluent having branched-chain and straight-chain hydrocarbons. The cycloparaffins can isomerize between cyclopentanes and cyclohexane compounds. Benzene can be saturated to form cyclohexane. In some embodiments, the $C_5$-$C_6$ isomerization zone 240 can include one or more isomerization reactors, feed-effluent heat exchangers, inter-reactor heat exchangers, driers, sulfur guards, separator, stabilizer, compressors, deisopentanizer column, deisohexanizer column, recycle streams and other equipment as known in the art (not shown). A hydrogen-rich gas stream (not shown) is typically mixed with the light stream 225 and heated to reaction temperatures. The hydrogen-rich gas stream, for example, comprises about 50-100 mol % hydrogen. The hydrogen can be separated from the reactor effluent, compressed and recycled back to mix with the light stream 225.

The $C_5/C_6$ rich stream 225 and hydrogen are contacted in the $C_5$-$C_6$ isomerization zone 240 with an isomerization catalyst forming $C_5$-$C_6$ isomerization effluent 245. The catalyst composites that can be used in the $C_5$-$C_6$ isomerization zone 240 include traditional isomerization catalysts including chlorided platinum alumina, crystalline aluminosilicates or zeolites, and other solid strong acid catalysts such as sulfated zirconia and modified sulfated zirconia. Suitable catalyst compositions of this type will exhibit selective and substantial isomerization activity under the operating conditions of the process.

Operating conditions within the isomerization zone are selected to maximize the production of isoalkane product from the feed components. Temperatures within the isomerization zone will usually range from about 40° to about 235° C. (100° to 455° F.). Lower reaction temperatures usually favor equilibrium mixtures of isoalkanes versus normal alkanes. Lower temperatures are particularly useful in processing feeds composed of $C_5$ and $C_6$ alkanes where the lower temperatures favor equilibrium mixtures having the highest concentration of the most branched isoalkanes. When the feed mixture is primarily $C_5$ and $C_6$ alkanes, temperatures in the range of from about 60° C. to about 160° C. are suitable. The isomerization zone may be maintained over a wide range of pressures. Pressure conditions in the isomerization of $C_4$-$C_6$ paraffins range from about 700 KPa(a) to about 7000 KPa(a). In other embodiments, pressures for this process are in the range of from about 2000 kPa(g) to 5000 kPa(g). The feed rate to the reaction zone can also vary over a wide range. These conditions include liquid hourly space velocities ranging from about 0.5 to about 12 $h^{-1}$ however, with some embodiments having space velocities between about 1 and about 6 $h^{-1}$.

The heavy stream 235 from the naphtha splitter 220 is sent to reformer 250 to form reformate 255. There may be any number of reaction zones, but usually the number of reaction zones is 3, 4 or 5. Because reforming reactions occur generally at an elevated temperature and are generally endothermic, each reaction zone usually has associated with it one or more heating zones, which heat the reactants to the desired reaction temperature. Due to coke build-up on reforming catalysts during normal operations, the catalyst must be periodically regenerated to re-establish fresh performance. The reformer in the present invention can be of any type including cyclic, semi-regenerative or continuous regeneration.

For a continuously regenerated reformer, the process can employ catalyst particles in several reaction zones interconnected in a series flow arrangement. The catalyst particles in the reformer are typically comprised of one or more Group VIII (IUPAC 8-10) noble metals (e.g., platinum, iridium, rhodium, and palladium) and a halogen combined with a porous carrier, such as a refractory inorganic oxide. U.S. Pat. No. 2,479,110, for example, teaches an alumina-platinum-halogen reforming catalyst. Although the catalyst may contain about 0.05 to about 2.0 wt-% of Group VIII metal, a less expensive catalyst, such as a catalyst containing about 0.05 to about 0.5 wt-% of Group VIII metal may be used. In addition, the catalyst may contain indium and/or a lanthanide series metal such as cerium. The catalyst particles may also contain one or more Group IVA (IUPAC 14) metals (e.g., tin, germanium, and lead), such as described in U.S. Pat. Nos. 4,929,333, 5,128,300, and the references cited therein. The halogen is typically chlorine, and alumina is commonly the carrier. Suitable alumina materials include, but are not limited to, gamma, eta, and theta alumina. One property related to the performance of the catalyst is the surface area of the carrier. Preferably, the carrier has a surface area of about 100 to about 500 $m^2/g$. The activity of catalysts having a surface area of less than about 130 $m^2/g$ tend to be more detrimentally affected by catalyst coke than catalysts having a higher surface area. Generally, the particles are usually spheroidal and have a diameter of about 1.6 to about 3.1 mm (about 1/16 to about 1/8 inch), although they may be as large as about 6.35 mm (about 1/4 inch) or as small as about 1.06 mm (about 1/24 inch). In a particular reforming reaction zone, however, it is desirable to use catalyst particles which fall in a relatively narrow size range.

Typical feed inlet temperature for the reformers are between 440 and 580° C. (824 and 1076° F.), or between 500 and 580° C. (932 and 1076° F.), or between 540 and 580° C. (1004 and 1076° F.), or at least above 540° C. (932° F.). The reformer reactors may have different operating temperatures, for example, a first reforming reactor having a temperature between 500 to 540° C. (932 to 1004° F.) and a second, subsequent reforming reactor having a temperature greater than 540° C. (1004° F.). The reformers can be operated at a range of pressures generally from atmospheric pressure of about 0 to about 6,895 kPa(g) (about 0 psig to about 1,000 psig), or about 276 to about 1,379 kPa(g) (about 40 to about 200 psig). The reaction conditions also include a liquid hour space velocity (LHSV) in the range from 0.6 $h^{-1}$ to 10 $h^{-1}$. Preferably, the LHSV is between 0.6 $h^{-1}$ and 5 $h^{-1}$, with a more preferred value between 1 $h^{-1}$ and 5 $h^{-1}$, and with a most preferred value between 2 $h^{-1}$ and 5 $h^{-1}$. The shorter residence time is especially preferred when utilizing the higher temperatures. The catalyst also has a residence time in the reformers of between 0.5 hours and 36 hours.

The $C_7$ stream 230 is sent to a $C_7$ dehydrogenation unit 265 to convert a portion of the saturated hydrocarbons to olefins in the presence of hydrogen over a selective platinum dehydrogenation catalyst. The process conditions utilized for the dehydrogenation reactor(s) are 0 to 50 psig, 0.5 to 6 hydrogen/hydrocarbon mole ratio, inlet reactor temperatures of 450 to 600° C., and 1 to 30 $h^{-1}$ LHSV. Conditions preferred for $C_7$ hydrocarbon feed stocks are 20 to 40 psig, about 3 to 5 hydrogen/hydrocarbon mole ratio, inlet reactor temperatures of about 520 to 560° C., and about 5 to 10 $h^{-1}$ LHSV. An adiabatic radial-flow reactor with feed preheat is used to minimize pressure drop within an efficient reactor volume. Hydrogen and some by-product light ends are separated (not shown) from the dehydrogenation reactor effluent 267, and a part of this hydrogen gas may be recycled back to dehydrogenation reactor 265 to minimize coking and enhance catalyst stability. The dehydrogenation reactor effluent is typically an equilibrium mixture of olefins and unconverted saturated hydrocarbons, which are charged to a selective hydrogenation unit 270 for the selective conversion of diolefins to mono-olefins. A hydrogen stream is also charged to the selective hydrogenation reactor 270. Typical selective hydrogenation conditions utilized are 25° C. to about 350° C., 40 to 800 psig, 5-35 $h^{-1}$ LHSV and a hydrogen to diolefin mole ratio of between about 1.4 to 2.0. The selective hydrogenation reactor effluent passes to a stripper (not shown) where dissolved light hydrocarbons are removed and the stripper bottoms, a mixture of mono-olefin hydrocarbons and unconverted saturated hydrocarbons stream 275 are sent for blending in gasoline pool 280. Other streams that are blended to the gasoline pool 280 include streams 260, 245, 255 and additional stream 290 comprising n-butane and isobutane and stream 295 comprising purchased or other available gasoline components. The gasoline pools are blended to make the octane targets with the Euro V specifications.

Figure 2:
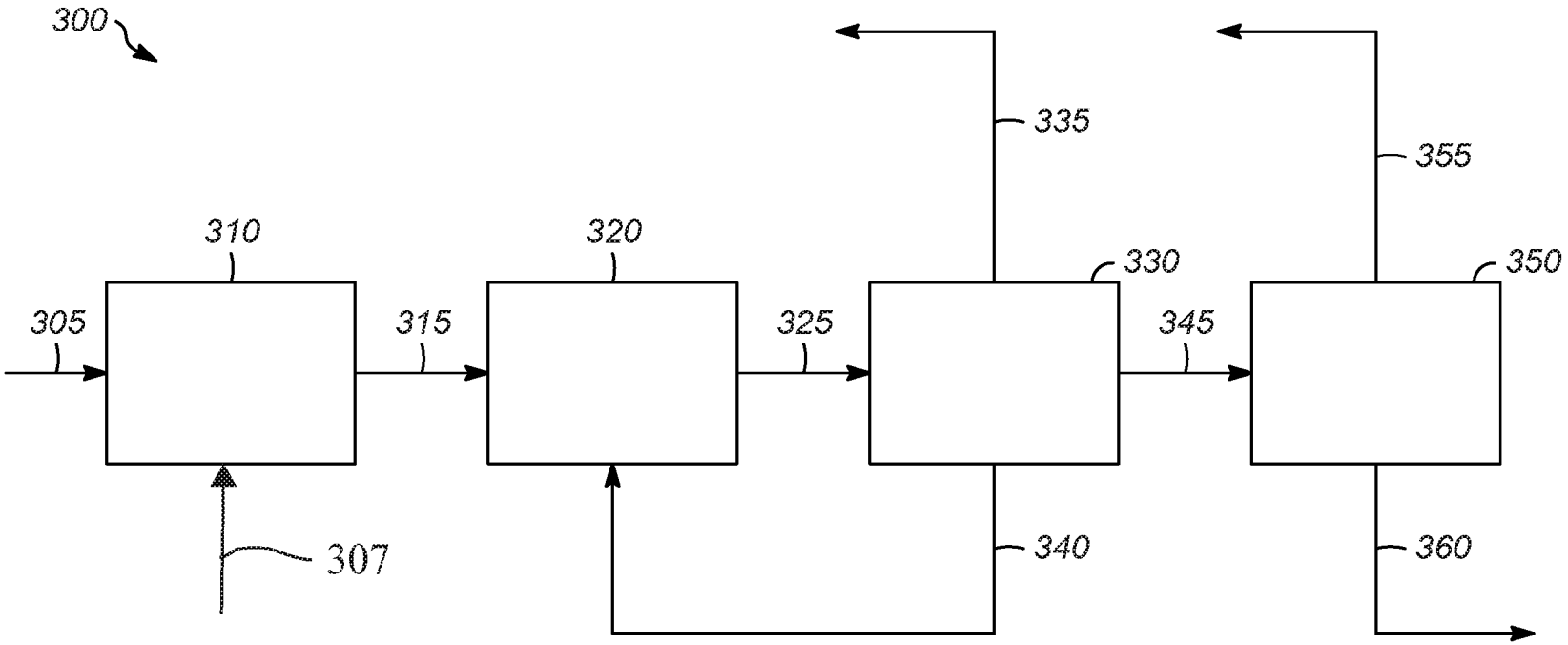
FIG. 2 shows an example of a dehydrogenation unit with its components.

FIG. 2 shows an example of a dehydrogenation unit (element 265 in FIG. 1) with its components. A $C_7$-rich stream 305 is shown entering feed section 310 is combined in some embodiments with stream 307 comprising $C_5$ and/or $C_6$ and/or $C_8$ normal paraffins, isoparaffins and/or cyclopentane compounds. The combined stream 315 enters dehydrogenation reactor section 320. A stream 325 having an increased proportion of olefins is sent to separator section 330 where hydrogen produced during the dehydrogenation reaction is either recycled in stream 340 to reactor section 320 or in stream 335 is sent to be used elsewhere in a refining complex such as in a reformer, hydrocracker, or hydrotreater. Stream 345 that contains the olefin-containing product is sent to fractionation section 350 with stream 355 containing lighter hydrocarbons sent for further processing and stream 360 sent to be mixed into the gasoline pool or to be processed in the selective hydrogenation unit (element 270 in FIG. 1) to remove diolefins prior to gasoline blending. Stream 360 is of higher octane value than the dehydrogenation feed stream 315 and is utilized for producing high octane gasoline.

In additional embodiments, the naphtha splitter (220 in FIG. 1) can be a divided wall column or the separation can be done in a series of columns to enable the desired fractionation. In some embodiments, additional reheat and dehydrogenation stages can be added to the dehydrogenation unit to increase the conversion of saturated hydrocarbons to olefins thus producing an even higher octane product. The addition of more stages involves higher investments and utilities for operations, but may be profitable depending on the higher octane selling price.

EXAMPLE 1

A $C_7$ cut of a hydrotreated naphtha was obtained which contained 7.2 wt % n-heptane, 31.1 wt % 2-methylhexane, 35.6 wt % 3-methyhexane, 17.0 wt % multi-branched $C_7$ iso-paraffins, 8.4 wt % $C_7$ cyclopentanes, 0.6 wt % methylcyclohexane and 0.02 wt % cyclohexane. The $C_7$ cut was combined with a 100% pure hydrogen stream using hydrogen/hydrocarbon mole ratios of about 3 and 5 and fed to a pilot plant operating at 20 psig. The conditions in the pilot plant were varied between 10 and 30 $h^{-1}$ LHSV and reactor inlet temperatures ranging from about 470 to 580° C. The dehydrogenation catalyst was a layered catalyst with the outer layer comprising gamma alumina with dispersed metals Pt, Sn and Li. The gas and liquid products were analyzed with on-line gas chromatographs. Peak assignments and molecular type groupings were aided by off-line GC-MS analyses of the liquid product effluents.

Table 1 shows a comparison of pilot plant data for 4 sets of conditions that achieved a $C_7$ paraffin conversion of 15.7%. The results demonstrate that a significant percentage of the converted $C_7$ paraffins were converted to mono-olefins and that for this specific feed, 10 $h^{-1}$ LHSV and 3 $H_2$/hydrocarbon mole ratio (Case A) produced the highest percentage of mono-olefins with the smallest combined percentage of less desired $C_1$-$C_6$ light ends, toluene and diolefins. Case D also demonstrates that operations at high space velocity and high temperature led to a high percentage of the converted $C_7$ hydrocarbons cracking to lighter $C_1$-$C_6$ hydrocarbons that consisted of both olefins and saturates. The cracking is thought to be a combination of both thermal cracking and catalytic cracking. In a commercial unit, the residence time in process lines and reactor spaces at high temperatures should be minimized to minimize thermal cracking reactions.

TABLE 1

Selectivities for dehydrogenation of a $C_7$ cut at constant 15.7% conversion.

| Case | A | B | C | D |
|---|---|---|---|---|
| LHSV, $h^{-1}$ | 10 | 10 | 30 | 30 |
| $H_2$/Hydrocarbon mole ratio | 3 | 5 | 3 | 5 |
| Average Bed Temp., ° C. | 492 | 505 | 521 | 551 |
| | Product Selectivity % for $C_7$ Paraffins Converted | | | |
| Hydrogen | 1.6 | 5.6 | 7.4 | 11.9 |
| $C_1$-$C_6$ Saturates and olefins | 7.6 | 10.8 | 19.2 | 38.2 |
| $nC_7$ Mono-olefins | 7.8 | 7.9 | 7.1 | 5.5 |
| $iC_7$ Mono-olefins | 65.2 | 59.8 | 50.3 | 30.4 |
| $C_7$ Cyclic Olefins* | 11.0 | 10.2 | 10.0 | 7.6 |
| $C_7$ Diolefins | 0.8 | 0.8 | 1.0 | 0.8 |
| Toluene | 5.9 | 4.8 | 5.1 | 5.6 |

*May have contained some diolefins, not resolved.

EXAMPLE 2

Some of the products made in the pilot plant testing in Example 1 were submitted for an engine research octane test and for bromine number analysis. The latter is an indicator of the olefinic content. The $C_7$ feed was also submitted for the engine octane test. Table 2 shows results for pilot plant tests operated at 20 psig and 3 $H_2$/hydrocarbon mole ratio. The results show that the bromine number and engine research octanes increased with increasing $C_7$ conversion. The net octane increase of the dehydrogenated products over the feed ranged from about +14 to +23 research octane numbers.

TABLE 2

Results of engine octane testing for products versus $C_7$ feed.

| Case | $C_7$ Feed | E | F | G |
|---|---|---|---|---|
| $C_7$ Conversion, % | 0.0 | 12.6 | 18.0 | 25.5 |
| LHSV, $h^{-1}$ | — | 30 | 30 | 10 |
| Bromine Number | — | 27 | 35 | 51 |
| Engine RON | 53.2 | 67.5 | 72.3 | 76.0 |
| Delta RON to Feed | — | +14.3 | +19.1 | +22.8 |

EXAMPLE 3

A $C_6$ cut of a hydrotreated naphtha was obtained which contained 1.3 wt % n-pentane, 1.6 wt % cyclopentane, 52.6 wt % 2-methylpentane, 16.6 wt % 3-methylpentane, 10.1 wt % 2,2-dimethylbutane, 14.8 wt % 2,3-dimethylbutane, 2.8 wt % n-hexane and 0.2 wt % methylcyclopentane. The $C_6$ cut was combined with a 100% pure hydrogen stream using hydrogen/hydrocarbon mole ratios of about 3 and fed to a pilot plant operated at 20 psig, 30 $h^{-1}$ LHSV and reactor inlet temperatures ranging from about 470 to 580° C. The dehydrogenation catalyst was a layered catalyst with the outer layer comprising gamma alumina with dispersed metals Pt, Sn and Li. The gas and liquid products were analyzed with on-line gas chromatographs. Peak assignments and molecular type groupings were aided by off-line GC-MS analyses of the liquid product effluents. The products were also submitted for bromine number and engine octane testing.

The data in Table 3 demonstrate the conversions, selectivities, and octane enhancements for the $C_6$ feed. The results show that the bromine number and engine research octanes increased overall with increasing $C_6$ conversion. The net octane increase of the dehydrogenated products over the feed ranged from about +12 to +17 research octane numbers.

TABLE 3

Conversions, selectivities and octanes for dehydrogenation with $C_6$ feed.

| Case | $C_6$ Feed | H | I | J | K | L |
|---|---|---|---|---|---|---|
| LHSV, $h^{-1}$ | — | 30 | 30 | 30 | 30 | 29 |
| $H_2$/Hydrocarbon mole ratio | — | 2.94 | 2.93 | 2.94 | 2.93 | 2.96 |
| Average Bed Temp, ° C. | — | 488 | 505 | 521 | 538 | 555 |
| Total $C_6$ Conversion, % | — | 10.6 | 13.8 | 17.3 | 21.4 | 26.3 |
| Selectivity of Reacted $C_6$'s, wt % | | | | | | |
| Hydrogen | — | 5.8 | 5.6 | 5.1 | 4.3 | 3.9 |
| $C_1$-$C_4$ Saturates and olefins | — | 2.6 | 3.3 | 5.3 | 10.7 | 19.2 |
| $C_5$ Saturates and olefins | — | 2.3 | 2.7 | 3.6 | 5.5 | 8.1 |
| $C_6$ Mono-olefins | — | 88.5 | 87.3 | 84.6 | 77.7 | 66.2 |
| $C_6$ Diolefins | — | 0.8 | 1.1 | 1.4 | 1.7 | 2.3 |
| $C_6$ Cyclic olefins | — | 0.0 | 0.0 | 0.0 | 0.0 | 0.0 |
| Benzene | — | 0.1 | 0.1 | 0.1 | 0.2 | 0.3 |
| Bromine Number | — | 20 | 19 | 31 | 35 | 41 |
| Engine RON | 72.4 | 84.5 | 85.4 | 87.3 | 89.0 | 89.4 |
| Delta RON to Feed | — | +12.1 | +13.0 | +14.9 | +16.6 | +17.0 |

Any of the above conduits, unit devices, scaffolding, surrounding environments, zones or similar may be equipped with one or more monitoring components including sensors, measurement devices, data capture devices or data transmission devices. Signals, process or status measurements, and data from monitoring components may be used to monitor conditions in, around, and on process equipment. Signals, measurements, and/or data generated or recorded by monitoring components may be collected, processed, and/or transmitted through one or more networks or connections that may be private or public, general or specific, direct or indirect, wired or wireless, encrypted or not encrypted, and/or combination(s) thereof; the specification is not intended to be limiting in this respect.

Signals, measurements, and/or data generated or recorded by monitoring components may be transmitted to one or more computing devices or systems. Computing devices or systems may include at least one processor and memory storing computer-readable instructions that, when executed by the at least one processor, cause the one or more computing devices to perform a process that may include one or more steps. For example, the one or more computing devices may be configured to receive, from one or more monitoring component, data related to at least one piece of equipment associated with the process. The one or more computing devices or systems may be configured to analyze the data. Based on analyzing the data, the one or more computing devices or systems may be configured to determine one or more recommended adjustments to one or more parameters of one or more processes described herein. The one or more computing devices or systems may be configured to transmit encrypted or unencrypted data that includes the one or more recommended adjustments to the one or more parameters of the one or more processes described herein.

SPECIFIC EMBODIMENTS

While the following is described in conjunction with specific embodiments, it will be understood that this description is intended to illustrate and not limit the scope of the preceding description and the appended claims.

A first embodiment of the invention is a process for production of gasoline comprising separating a naphtha feed in a naphtha splitter into a stream comprising i-$C_5$, a stream comprising $C_6$ and lighter boiling hydrocarbons, a $C_7$ stream comprising $C_7$ hydrocarbons, and a heavy stream comprising $C_8$ and heavier hydrocarbons; isomerizing at least a portion of the stream comprising $C_6$ and lighter boiling hydrocarbons in a $C_5$-$C_6$ isomerization zone at isomerization conditions to form a $C_5$-$C_6$ isomerization effluent; dehydrogenating at least a portion of the stream comprising $C_7$ hydrocarbons to form a $C_7$ dehydrogenation effluent comprising $C_7$ olefins; reforming the heavy stream in a reforming zone under reforming conditions forming a reformate stream; blending one or more of the stream comprising i-$C_5$, the $C_5$-$C_6$ isomerization effluent, the $C_7$ dehydrogenation effluent and the reformate stream to form a gasoline blend. An embodiment of the invention is one, any or all of prior embodiments in this paragraph up through the first embodiment in this paragraph wherein the $C_7$-rich stream further comprises at least one hydrocarbon selected from the group consisting of $C_5$, $C_6$, and $C_8$ paraffins, iso-paraffins and cyclopentanes. An embodiment of the invention is one, any or all of prior embodiments in this paragraph up through the first embodiment in this paragraph wherein the $C_7$-rich stream further comprises a $C_5$-rich stream. An embodiment of the invention is one, any or all of prior embodiments in this paragraph up through the first embodiment in this paragraph wherein the $C_7$-rich stream further comprises a $C_6$-rich stream. An embodiment of the invention is one, any or all of prior embodiments in this paragraph up through the first embodiment in this paragraph wherein the $C_7$-rich stream further comprises a $C_8$-rich stream. An embodiment of the invention is one, any or all of prior embodiments in this paragraph up through the first embodiment in this paragraph wherein the $C_7$ dehydrogenation effluent comprises mono-olefins. An embodiment of the invention is one, any or all of prior embodiments in this paragraph up through the first embodiment in this paragraph wherein the mono-olefins are selected from the group consisting of 1-heptene, trans-2-heptene, trans-3-heptene, trans-3-heptene and cis-2-heptene and cis-3-heptene. An embodiment of the invention is one, any or all of prior embodiments in this paragraph up through the first embodiment in this paragraph wherein isoparaffins are dehydrogenated to a corresponding mono iso-olefin. An embodiment of the invention is one, any or all of prior embodiments in this paragraph up through the first embodiment in this paragraph wherein the $C_7$ dehydrogenation feed contains less than 1.5 wt % cyclcohexanes. An embodiment of the invention is one, any or all of prior embodiments in this paragraph up through the first embodiment in this paragraph wherein the $C_7$ dehydrogenation effluent is contacted with a near-stoichiometric amount of hydrogen and passed over a selective hydrogenation catalyst to convert the diolefins to mono-olefins. An embodiment of the invention is one, any or all of prior embodiments in this paragraph up through the first embodiment in this paragraph wherein the dehydrogenation effluent further comprises diolefins. An embodiment of the invention is one, any or all of prior embodiments in this paragraph up through the first embodiment in this paragraph wherein the dehydrogenation effluent is hydrogenated in a hydrogenation zone to convert the diolefins to mono-olefins. An embodiment of the invention is one, any or all of prior embodiments in this paragraph up through the first embodiment in this paragraph, further comprising at least one of sensing at least one parameter of the process and generating a signal or data from the sensing; generating and transmitting a signal; or generating and transmitting data.

A second embodiment of the invention is a process for production of gasoline comprising separating a naphtha feed in a naphtha splitter into a stream comprising i-$C_5$, a stream comprising $C_6$ and lighter boiling hydrocarbons, a $C_7$ stream comprising $C_7$ hydrocarbons, and a heavy stream comprising $C_8$ and heavier hydrocarbons; isomerizing at least a portion of the stream comprising $C_6$ and lighter boiling hydrocarbons in a $C_5$-$C_6$ isomerization zone at isomerization conditions to form a $C_5$-$C_6$ isomerization effluent; dehydrogenating at least a portion of the stream comprising $C_7$ hydrocarbons to form a $C_7$ dehydrogenation effluent comprising $C_7$ olefins and diolefins; hydrogenating the $C_7$ dehydrogenation effluent reforming the heavy stream in a reforming zone under reforming conditions forming a reformate stream; blending one or more of the stream comprising i-$C_5$, the $C_5$-$C_6$ isomerization effluent, the $C_7$ dehydrogenation effluent and the reformate stream to form a gasoline blend. An embodiment of the invention is one, any or all of prior embodiments in this paragraph up through the second embodiment in this paragraph wherein the $C_7$ dehydrogenation effluent is hydrogenated in a hydrogenation zone to convert the diolefins to mono-olefins. An embodiment of the invention is one, any or all of prior embodiments in this paragraph up through the second embodiment in this paragraph wherein the $C_7$ dehydrogenation effluent comprises mono-olefins. An embodiment of the invention is one, any or all of prior embodiments in this paragraph up through the second embodiment in this paragraph wherein the mono-olefins are selected from the group consisting of 1-heptene, trans-2-heptene, trans-3-heptene, trans-3-heptene and cis-2-heptene and cis-3-heptene. An embodiment of the invention is one, any or all of prior embodiments in this paragraph up through the second embodiment in this paragraph wherein the $C_7$ dehydrogenation feed contains less than 1.5 wt % cyclohexanes. An embodiment of the invention is one, any or all of prior embodiments in this paragraph up through the second embodiment in this paragraph wherein the $C_7$ dehydrogenation effluent is contacted with a near stoichiometric amount of hydrogen and passed over a selective hydrogenation catalyst to convert the diolefins to mono-olefins. An embodiment of the invention is one, any or all of prior embodiments in this paragraph up through the second embodiment in this paragraph, further comprising at least one of sensing at least one parameter of the process and generating a signal or data from the sensing; generating and transmitting a signal; or generating and transmitting data.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

The invention claimed is:

1. A process for production of gasoline comprising:

a. separating a naphtha feed in a naphtha splitter into a stream comprising i-$C_5$, a stream comprising $C_6$ and lighter boiling hydrocarbons, a $C_7$ stream comprising $C_7$ hydrocarbons, and a heavy stream comprising $C_8$ and heavier hydrocarbons;

b. isomerizing at least a portion of the stream comprising $C_6$ and lighter boiling hydrocarbons in a $C_5$-$C_6$ isomerization zone at isomerization conditions to form a $C_5$-$C_6$ isomerization effluent;

c. dehydrogenating at least a portion of the $C_7$ stream comprising $C_7$ hydrocarbons to form a $C_7$ dehydrogenation effluent comprising $C_7$ olefins;

d. reforming the heavy stream in a reforming zone under reforming conditions forming a reformate stream;

e. blending one or more of the stream comprising i-$C_5$, the $C_5$-$C_6$ isomerization effluent, the $C_7$ dehydrogenation effluent and the reformate stream to form a gasoline blend.

2. The process of claim 1 wherein the $C_7$ stream comprising $C_7$ hydrocarbons further comprises at least one hydrocarbon selected from the group consisting of $C_5$, $C_6$, and $C_8$ paraffins, iso-paraffins and cyclopentanes.

3. The process of claim 1 wherein the $C_7$ stream comprising $C_7$ hydrocarbons further comprises a $C_5$-rich stream.

4. The process of claim 1 wherein the $C_7$ stream comprising $C_7$ hydrocarbons further comprises a $C_6$-rich stream.

5. The process of claim 1 wherein the $C_7$ stream comprising $C_7$ hydrocarbons further comprises a $C_8$-rich stream.

6. The process of claim 1 wherein the $C_7$ dehydrogenation effluent comprises mono-olefins.

7. The process of claim 6 wherein the mono-olefins are selected from the group consisting of 1-heptene, trans-2-heptene, trans-3-heptene, trans-3-heptene and cis-2-heptene and cis-3-heptene.

8. The process of claim 1 wherein, while dehydrogenating, isoparaffins from the $C_7$ stream are dehydrogenated to a corresponding mono iso-olefin.

9. The process of claim 1 wherein a $C_7$ dehydrogenation feed to the contains less than 1.5 wt % cyclcohexanes.

10. The process of claim 1 wherein the $C_7$ dehydrogenation effluent is contacted with hydrogen and passed over a selective hydrogenation catalyst to convert the diolefins to mono-olefins.

11. The process of claim 1 wherein said $C_7$ dehydrogenation effluent further comprises diolefins.

12. The process of claim 2 wherein said $C_7$ dehydrogenation effluent is hydrogenated in a hydrogenation zone to convert said diolefins to mono-olefins.

13. The process of claim 1, further comprising at least one of:

sensing at least one parameter of the process and generating a signal or data from the sensing;

generating and transmitting a signal; or generating and transmitting data.

14. A process for production of gasoline comprising:

a. separating a naphtha feed in a naphtha splitter into a stream comprising i-$C_5$, a stream comprising $C_6$ and lighter boiling hydrocarbons, a $C_7$ stream comprising $C_7$ hydrocarbons, and a heavy stream comprising $C_8$ and heavier hydrocarbons;

b. isomerizing at least a portion of the stream comprising $C_6$ and lighter boiling hydrocarbons in a $C_5$-$C_6$ isomerization zone at isomerization conditions to form a $C_5$-$C_6$ isomerization effluent;

c. dehydrogenating at least a portion of the $C_7$ stream comprising $C_7$ hydrocarbons to form a $C_7$ dehydrogenation effluent comprising $C_7$ olefins and diolefins;

d. hydrogenating the $C_7$ dehydrogenation effluent;

e. reforming the heavy stream in a reforming zone under reforming conditions forming a reformate stream;

f. blending one or more of the stream comprising i-$C_5$, the $C_5$-$C_6$ isomerization effluent, the $C_7$ dehydrogenation effluent and the reformate stream to form a gasoline blend.

15. The process of claim 14 wherein said $C_7$ dehydrogenation effluent is hydrogenated in a hydrogenation zone to convert said $C_7$ diolefins to mono-olefins.

16. The process of claim 14 wherein the $C_7$ dehydrogenation effluent comprises mono-olefins.

17. The process of claim 16 wherein the mono-olefins are selected from the group consisting of 1-heptene, trans-2-heptene, trans-3-heptene, trans-3-heptene and cis-2-heptene and cis-3-heptene.

18. The process of claim 14 wherein said $C_7$ dehydrogenation feed contains less than 1.5 wt % cyclohexanes.

19. The process of claim 14 wherein the $C_7$ dehydrogenation effluent is contacted with hydrogen and passed over a selective hydrogenation catalyst to convert the $C_7$ diolefins to mono-olefins.

20. The process of claim 14, further comprising at least one of:

sensing at least one parameter of the process and generating a signal or data from the sensing;

generating and transmitting a signal; or generating and transmitting data.

* * * * *